US005741108A

United States Patent [19]

Rolfe

[11] Patent Number: 5,741,108

[45] Date of Patent: Apr. 21, 1998

[54] DRUM EMPTYING APPARATUS

[76] Inventor: John I. Rolfe, 337 Riverview Dr., Youngstown, N.Y. 14174

[21] Appl. No.: 636,037

[22] Filed: Apr. 22, 1996

[51] Int. Cl.[6] ..... B08B 9/38

[52] U.S. Cl. ..... 414/416; 15/93.1; 15/104.096; 141/256; 241/277

[58] Field of Search ..... 414/416; 141/256, 141/258, 259; 15/93.1, 104.05, 104.096; 241/277, 278.1

[56] References Cited

U.S. PATENT DOCUMENTS

| | | | |
|---|---|---|---|
| 223,743 | 1/1880 | Macy, Jr. | 414/416 |
| 334,488 | 1/1886 | Taylor . | |
| 502,414 | 8/1893 | Flower et al. . | |
| 542,669 | 7/1895 | Winterbotham . | |
| 999,208 | 8/1911 | Cluthe . | |
| 1,145,927 | 7/1915 | Shorten | 414/416 |
| 1,347,649 | 7/1920 | Mosher | 15/104.096 |
| 1,888,032 | 11/1932 | Fischer | 15/104.096 |
| 2,115,439 | 4/1938 | Wolfner | 15/58 |
| 2,558,983 | 7/1951 | Roberts | 15/57 |
| 3,905,061 | 9/1975 | Cradeur | 15/4 |
| 4,957,222 | 9/1990 | Rolfe | 222/148 |
| 5,022,328 | 6/1991 | Robertson | 110/232 |
| 5,413,154 | 5/1995 | Hurst, Jr. et al. | 141/256 |
| 5,417,169 | 5/1995 | Carpenter et al. | 110/222 |

*Primary Examiner*—J. Casimer Jacyna
*Attorney, Agent, or Firm*—Bean, Kauffman & Snyder

[57] ABSTRACT

An apparatus for removing material from a drum or barrel includes a conveyor for transporting drums one at a time through an emptying station at which a housing having an open end is arranged for sealing engagement with an annular rim of a drum bounding an opening through which material is to be withdrawn. The emptying station additionally includes a mechanism adapted to lift drums from the conveyor and place same in sealing engagement with the housing, a scraper supported to movably project from within the housing through its open end and into the opening of a sealingly engaged drum for scraping material from the walls thereof and conveying such material outwardly of the drum into the housing for subsequent discharge therefrom through a discharge opening. The discharge opening communicates with an inlet opening of an axially elongated material conveyor serving to transport material from its inlet opening to a discharge opening removably communicating with a material receiver. The housing is fixed to the material conveyor and the material conveyor is supported for rotary movement about a horizontally disposed axis, whereby to effect vertical tilting of the sealing engaged drum and facilitate movement of material therefrom and through the housing into the material conveyor and subsequent discharge of material therefrom into the material receiver.

14 Claims, 7 Drawing Sheets

FIG. 1
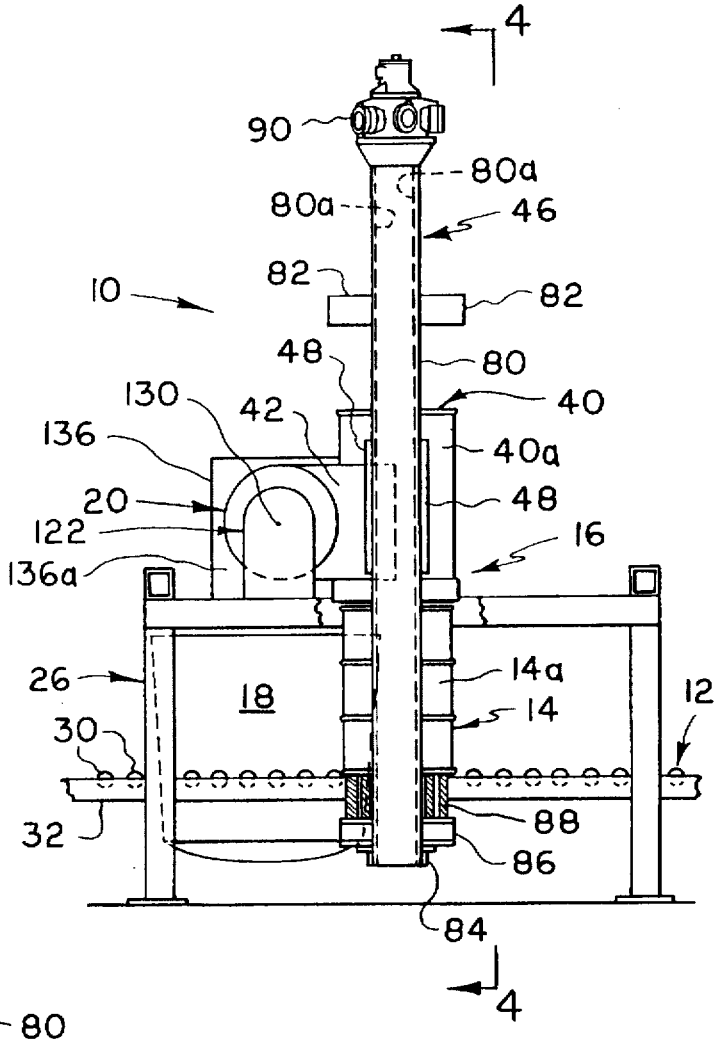
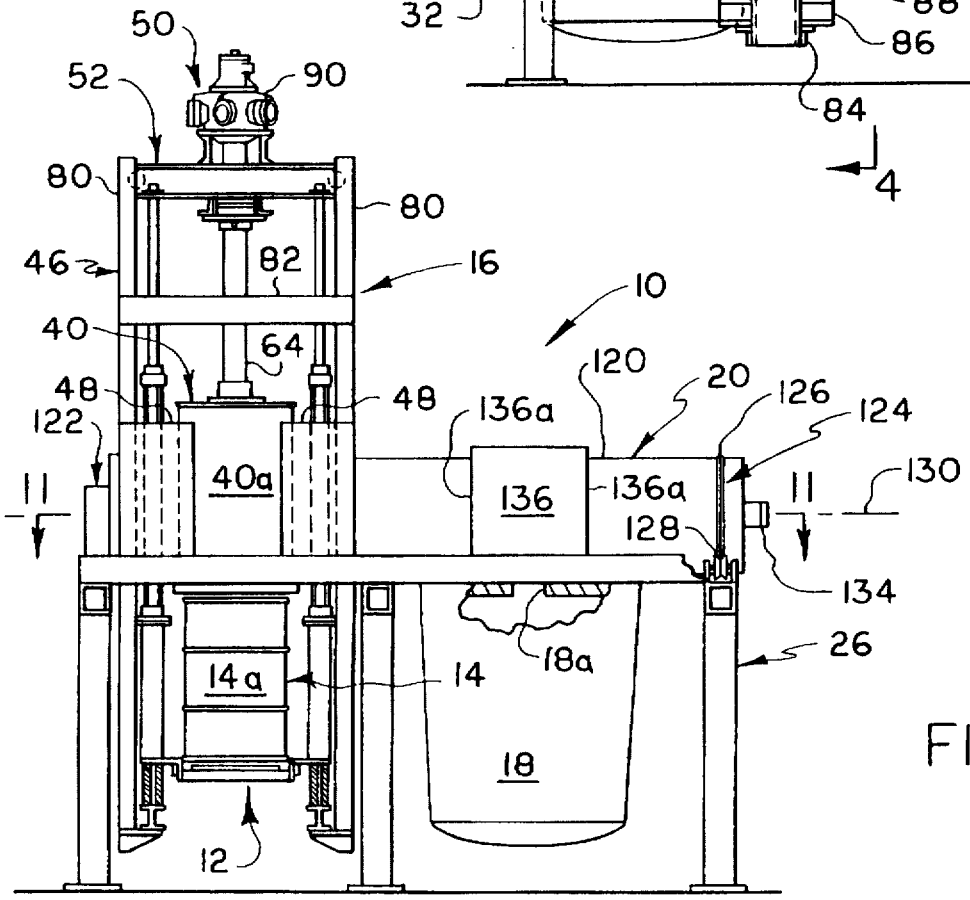
FIG. 2

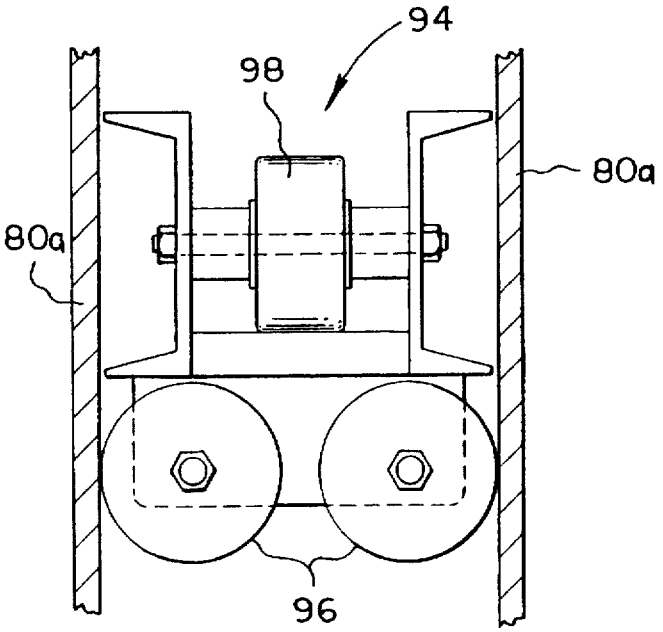
FIG. 8
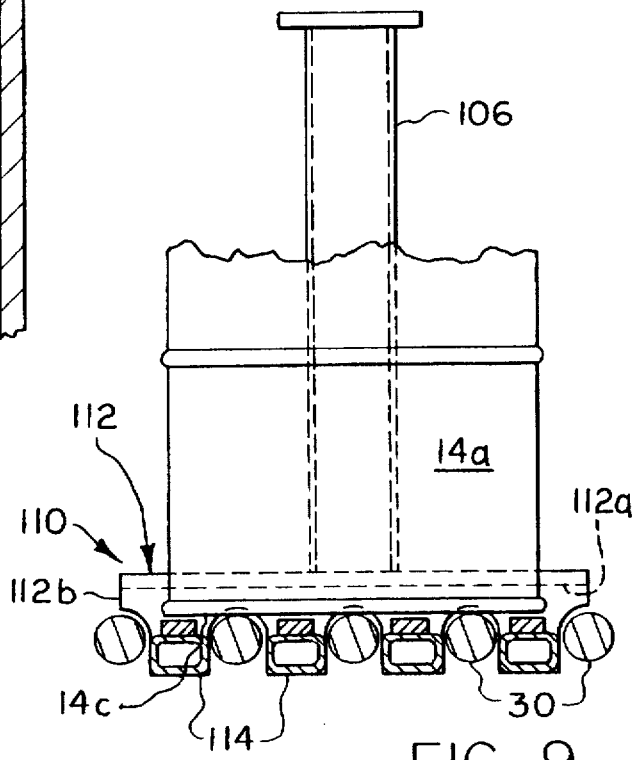
FIG. 9
FIG. 10
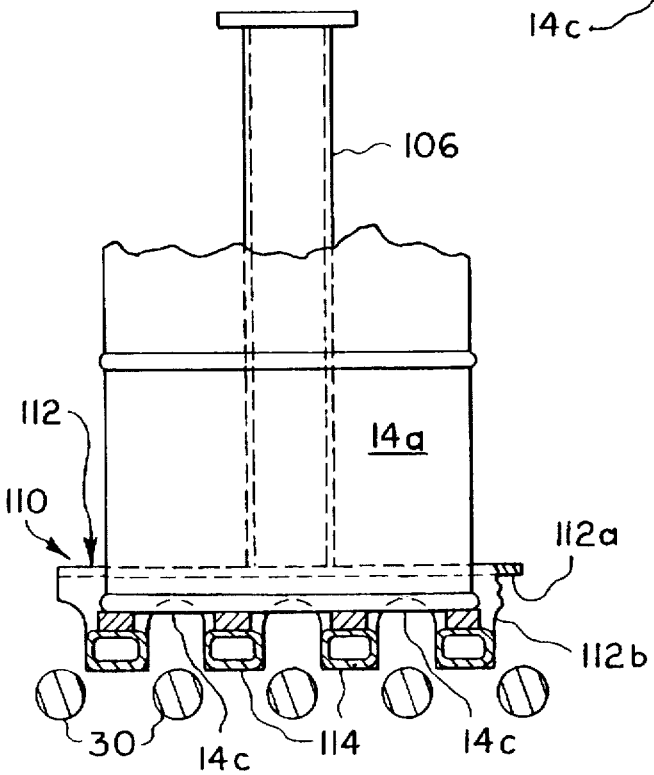
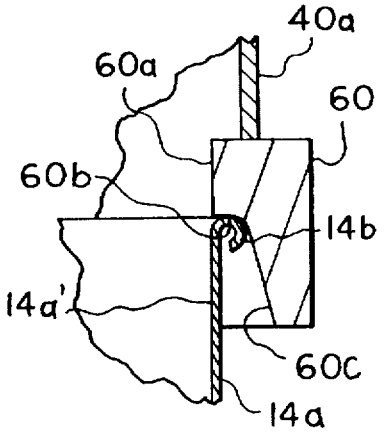
FIG. 7

DRUM EMPTYING APPARATUS

BACKGROUND OF THE INVENTION

It has been proposed to remove material from a drum or barrel by a motor driven auger removably inserted into such drum, as evidenced for example by U.S. Pat. Nos. 1,145,927 and 5,417,169.

Further, in U.S. Pat. No. 5,417,169 and in my prior U.S. Pat. No. 4,957,222, apparatus has been provided for inverting a drum to facilitate flow of material therefrom during a material extraction operation.

A drawback of prior drum emptying apparatus of the type described by the foregoing patents is that material extracted from the drum is permitted to flow downwardly into a receiver in a non-confined manner. As a result, fumes escaping from the extracted material are permitted to escape into the environment unless collected by means of an exterior housing as in U.S. Pat. No. 5,417,169.

SUMMARY OF THE INVENTION

The present invention is directed towards apparatus for removing materials from drums or barrels and more particularly to apparatus for removing materials from drums and transporting same in a confined manner to a receiver or storage container, so as to minimize the escape of fumes into the environment.

In the present apparatus, a conveyor is provided for transporting drums one at a time through an emptying station at which a housing having an open end is arranged for sealing engagement with an annular rim of a drum bounding an opening through which material is to be withdrawn. The emptying station additionally includes a mechanism adapted to lift drums from the conveyor and place same in sealing engagement with the housing, a scraper supported to movably project from within the housing through its open end and into the opening of a sealingly engaged drum for scraping material from the walls thereof and conveying such material outwardly of the drum into the housing for subsequent discharge therefrom through a discharge opening. The discharge opening communicates with an inlet opening of an axially elongated material conveyor serving to transport material from its inlet opening to a discharge opening removably communicating with a material receiver. The housing is fixed to the material conveyor and the material conveyor is supported for rotary movement about a horizontally disposed axis, whereby to effect vertical tilting of the sealing engaged drum and facilitate movement of material therefrom and through the housing into the material conveyor and subsequent discharge of material therefrom into the material receiver.

BRIEF DESCRIPTION OF THE DRAWINGS

The nature and mode of operation of the present invention will now be more fully described in the following detailed description taken with the accompanying drawings wherein:

FIG. 1 is a side elevational view of a Drum Emptying Apparatus of the present invention.

FIG. 2 is an end elevational view thereof taken from the right of FIG. 1;

FIG. 7 is an enlarged view of the area designated as "A" in FIG. 5;

FIG. 8 is an enlarged sectional view taken generally along the line 8—8 in FIG. 4;

FIG. 9 is an enlarged sectional view taken generally along the line 9—9 in FIG. 4;

FIG. 10 is an enlarged sectional view taken generally along the line 10—10 in FIG. 5.

DETAILED DESCRIPTION

Figure 3:
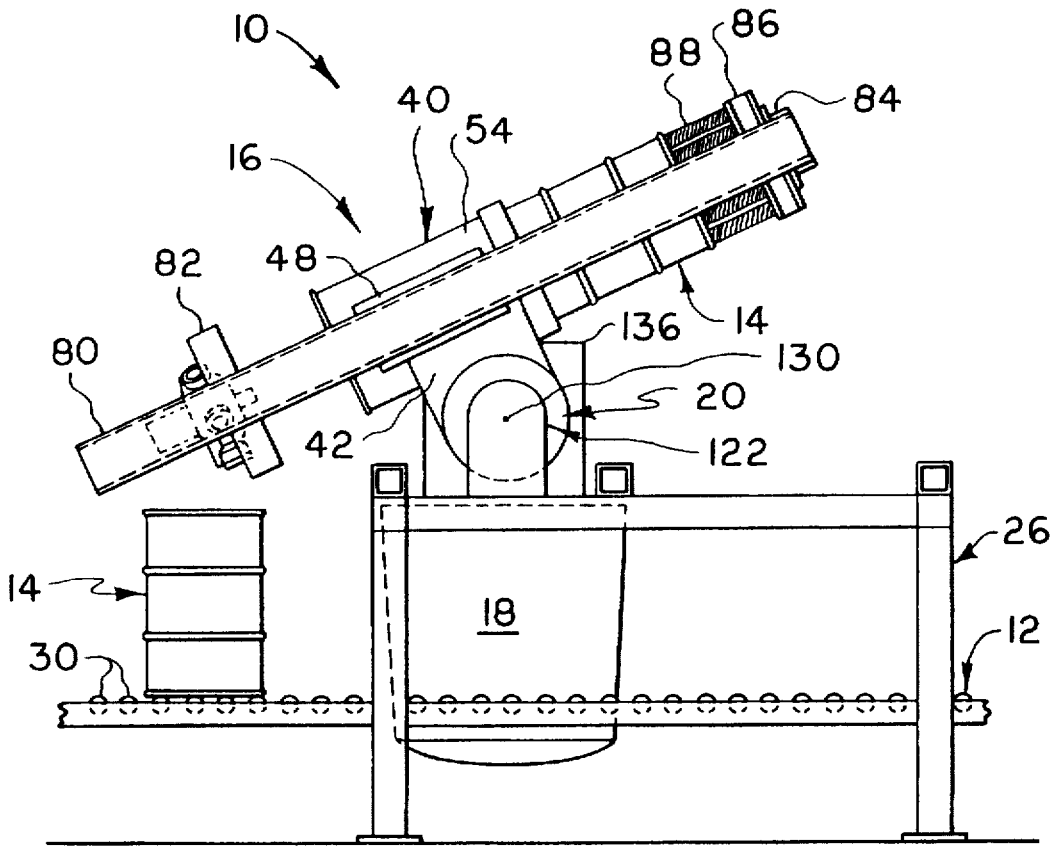
FIG. 3 is a view similar to FIG. 1, but showing a drum in tilted condition during emptying thereof.

Reference is first made to FIGS. 1–3, wherein a drum emptying apparatus formed in accordance with a preferred form of the present invention is generally designated as 10 and shown as including a conveyor 12 for transporting drums or barrels 14 towards and away from a drum emptying station at which is dispersed a drum emptying mechanism 16, a receiver means 18 for storage of material removed from drums 14; a material conveyor 20 having annularly offset or spaced material inlet and discharge openings 22 and 24, shown only in FIG. 10, for transporting material from mechanism 16 to receiver 18; and a framework 26 for supporting material conveyor 20.

Drums 14 may be standard 55 gallon drums from which top end closures, not shown, have been removed prior to transport to the emptying station. Such drums are considered as comprising a generally cylindrical side wall 14*a*, which has its open upper end bounded by an annular rim 14*b* and its lower end closed by a bottom end closure 14*c*.

Figure 5:
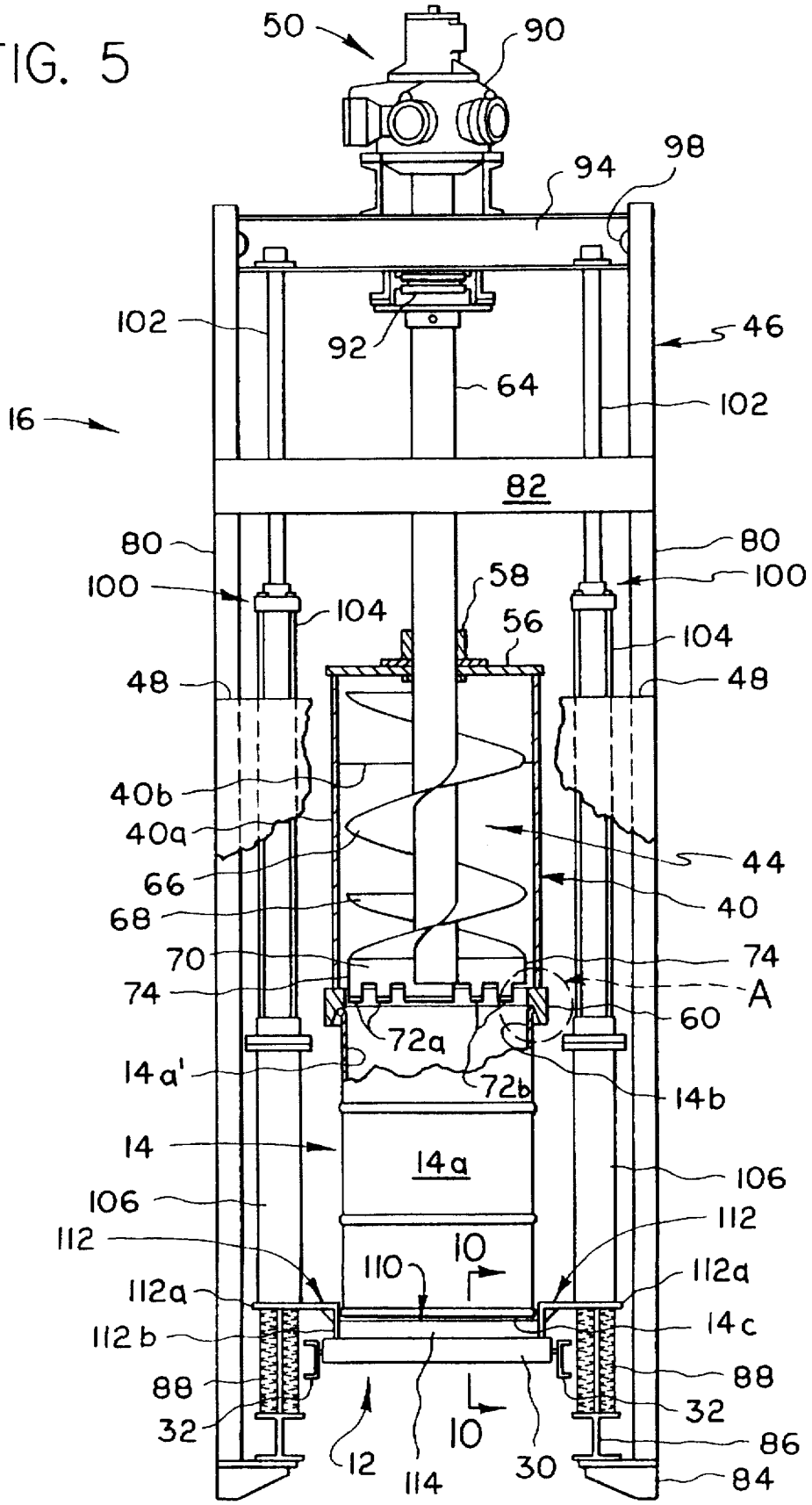
FIG. 5 is a view similar to FIG. 4, but showing the drum emptying mechanism engaged with a drum.

Conveyor 12 is shown for example in FIGS. 1, 5 and 9 as including a plurality of drum supporting rollers 30 having their opposite ends rotatably supported by a pair of parallel, horizontally-extending channel members 32, such that the rollers reside in a uniformly-spaced parallel relationship and cooperate to supportingly underengage drum bottom closure 14*c*. The rollers may be suitably powered or not depending on installation requirements.

Receiver means 18 may be variously defined, such as by a receptacle having an upwardly facing inlet opening 18a shown only in FIG. 2, which may be removably positioned beneath conveyor discharge opening 24 for replacement when filled to capacity.

Drum emptying mechanism 16 is shown in FIGS. 1–6 as generally including a scraper housing 40 fixed to and supported by material conveyor 20 by a discharge conduit 42 having a first end communicating with conveyor inlet opening 22; a scraper head 44 arranged within housing 40; generally H-shaped frame 46 fixed to the scraper housing by a pair of mounting brackets 48 and 48; a scraper drive mechanism 50; and a drum lifting and scraper extending mechanism 52.

Scraper housing 40 is best shown in FIG. 5 as including a generally cylindrical side wall 40a having an upper end closed by a closure plate 56 mounting a centrically located through bearing 58, a material discharge opening 40*b* arranged in flow communication with a second end of discharge conduit 42 and an open lower end bounded by an annular sealing flange 60. As best shown in FIG. 7, flange 60 has an inwardly-facing annular surface 60*a* having a diameter corresponding essentially to that of the inner surface 14a' of drum side wall 14a; an axially-facing annular clamping surface 60b arranged and shaped to sealingly engage with drum rim 14b; and an axially facing, generally frustroconical guide surface 60c arranged to engage with drum rim 14b and guide same into aligned clamping engagement with clamping surface 60b, whereupon surfaces 60a and 14a' are disposed in essential axial alignment.

Scraper head 44 is best shown in FIG. 5 as including a drive shaft 64, which is supported by through bearing 58 for both rotational and axial sliding movement relative to scraper housing 40; a primary scraping and conveying auger in the form of a helical blade 66 which is fixed to the lower end of drive shaft 64 to extend slightly less than the axial inner length of scraper housing 40; a secondary emptying and conveying auger in the form of a helical blade 68, which is fixed to the lower end of drive shaft 64 and extends only through a portion of the length of blade 66; and a scraper plate 70 carried by the lower end of drive shaft 64 to extend radially thereof. Scraper plate 70 has an inner or upper mounting edge suitably fixed, as by welding, to the axially lower ends of blades 66 and 68; a lower scraper edge cut away to define first and second groups of teeth 72a and 72b, which are radially offset relative to one another, and parallel end edges 74 and 74. End edges 74 and 74 are aligned with the scraping edges of blades 66 and 68, whose diameter is slightly less than the diameter of flange inner surface 60a and drum inner surface 14a', thereby to permit scraping of material from such drum inner surface.

Frame 46 includes a pair of parallel, U-shaped channel members 80 and 80, which are joined by a pair of parallel, transversely extending bracing channel members 82 and 82. Lower ends of members 80 and 80 are fitted with weldments 84 and 84 to which are fixed a pair of I-beams 86 and 86 serving to supportingly engage the lower ends of parallel, upstanding compression springs 88 and 88. Springs 88 and 88 serve to define lifting means for lifting drums 14 off of conveyor 12 for engagement with scraper housing 40 in the manner to be described.

Figure 4:
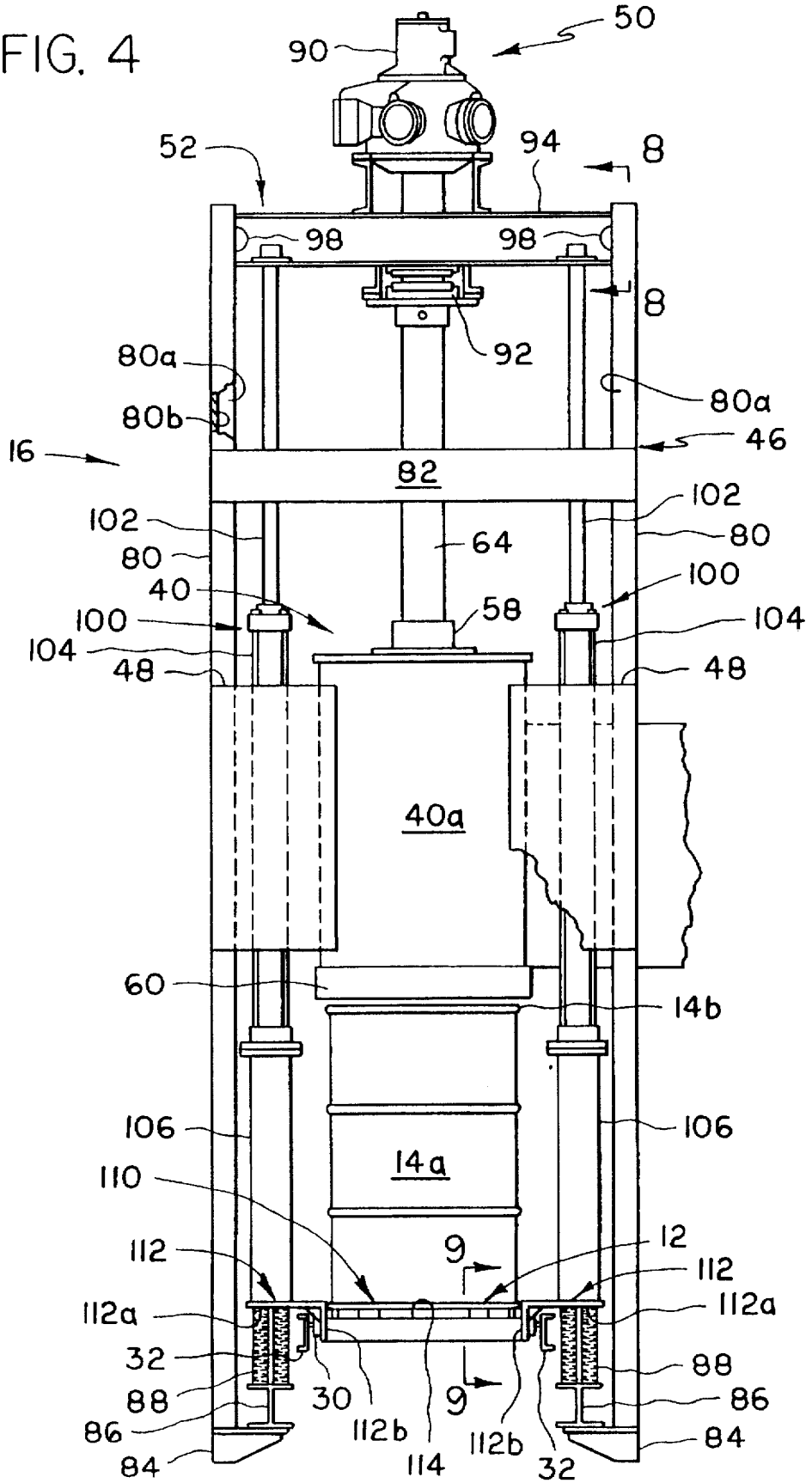
FIG. 4 is an enlarged view taken generally along the line 4—4 in FIG. 1.

Scraper drive mechanism 50 is shown in FIG. 4 as generally including a drive motor 90 drivingly connected to the upper end of drive shaft 64 by a coupling 92 suitably supported together with the motor by a horizontally disposed guide member 94 forming part of scraper extending mechanism 52. Guide member 94 mounts a pair of guide rollers shown only in FIG. 8 as 96 and 96, adjacent each of its ends for rolling engagement with facing surfaces of flanges 80a and 80a of each of frame members 80 and 80, and a single guide roller 98 adjacent each of its ends for rolling engagement with the base or connecting flange 80b of each of frame members 80, as shown only in FIG. 4. Rollers 96 and 98 support guide member 94 for movement lengthwise of frame members 80 and 80 between the extended and retracted positions shown in FIGS. 4 and 6 with the limit of the FIG. 4 position being defined by suitable abutments, not shown.

Mechanism 52 includes, in addition to guide member 94, a pair of hydraulic cylinders 100 and 100, which include piston rods 102 and 102 having their upper ends connected to guide member 94 and cylinder members 104 and 104 having their lower ends fixed to upstand from a pair of connecting members or columns 106 and 106. The lower ends of connecting members 106 and 106 are coupled by a drum support fixture 110, which bridges transversely across conveyor 12 and has its opposite ends supported by the upper ends of compression springs 88 and 88. Drum support fixture 110 is shown in FIGS. 5, 9 and 10 as including a pair of parallel L-shaped flanges 112 and 112, which have horizontal flange portions 112a and 112a fixed to connecting members 106 and 106 and parallel, vertical flange portions 112b and 112b fixed to opposite ends of a plurality of parallel and horizontally-extending drum support members 114 and arranged to lie intermediate conveyor channel members, as best shown in FIG. 5. By referring to FIGS. 9 and 10, it will be seen that support members 114 are arranged parallel to and intermediate rollers 30, and adapted for vertical movement in the manner to be described between a lower inoperative position in which they are disposed below the level of rollers 30 and an upper operative position in which they are arranged above the level of such rollers and serve to underengage drum bottom end closure 14c.

It will be understood that when piston rods 102 and 102 are in their fully extended condition, as viewed in FIG. 4, support members 114 are disposed vertically below conveyor rollers 30, and I-beams 86 and 86 cooperate with flange portions 112a and 112a to maintain springs 86 and 86 in a highly compressed state.

Figure 11:
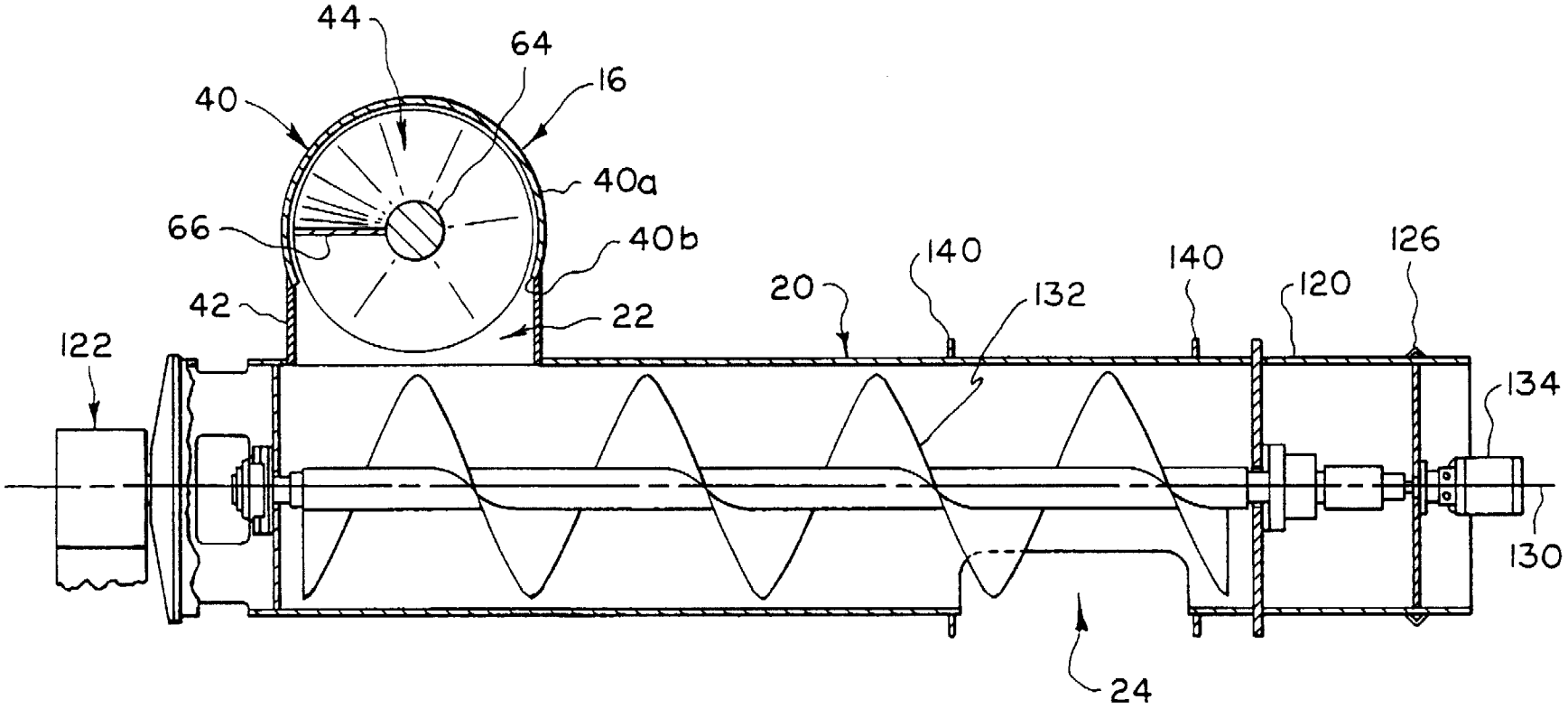
FIG. 11 is an enlarged sectional view taken generally along the line 11—11 in FIG. 2, but with the material conveyor shown as being rotated into a material discharge position.

Material conveyor 20 is best shown in FIGS. 2 and 11 as including a generally cylindrical, tubular housing 120, which is supported adjacent its horizontal opposite ends on framework 26 by a housing drive mechanism 122 and a bearing device 124 defined by a housing mounted annular bearing ring 126 and a pair of grooved, guide/support rollers 128 mounted on framework 26. Drive mechanism 122 may include a suitable reversible hydraulic motor, not shown, for effecting oppositely directed rotational movements of housing 120 about a horizontally disposed axis 130 for alternatingly tilting or swinging scraper housing 40 between the drum pickup and drum emptying positions shown in FIGS. 1 and 3, respectively.

Conveyor 20 additionally includes a helical screw conveyor or auger 132, which extends axially within housing 120 and is selectively driven by a housing mounted motor 134 for purposes transporting material from inlet opening 22 to discharge opening 24 from which such material passes to receiver means 18 through a hollow hood 136. Hood 136 includes a pair of horizontally aligned, circular openings, not shown, sized to rotatably receive housing 120 extending therethrough and a downwardly opening discharge opening, also not shown, arranged for flow communication with receiver means inlet opening 18a. Preferably, housing 120 is provided with a pair of annular sealing rings 140 arranged to axially bound discharge opening 24 and cooperate with a pair of side walls 136a, of 136a hood 136 bounding its circular openings to prevent escape of material/fumes introduced into the hood through discharge opening 24 by operation of screw 132 in opposite directions extending axially along the outer surface of housing 120. Hood 136 may be removably sealed to receiver means 18 in any suitable manner.

By again viewing FIG. 11, it will be understood that material inlet and discharge openings 22 and 24 of housing 120 are intentionally annularly offset relative to one another in order to facilitate movement of material into, through and out of housing 120. Specifically, it will be understood that when housing 120 has been rotated to place scraper housing 40 in its drum emptying position shown in FIG. 3, material inlet opening 22 is arranged to open generally upwardly to receive material being removed from drum 14 by operation of scraper head 44 and material discharge opening 24 is arranged to open generally downwardly to direct material downwardly into receiver means 18 through hood 136 under the influence of gravity.

Figure 6:
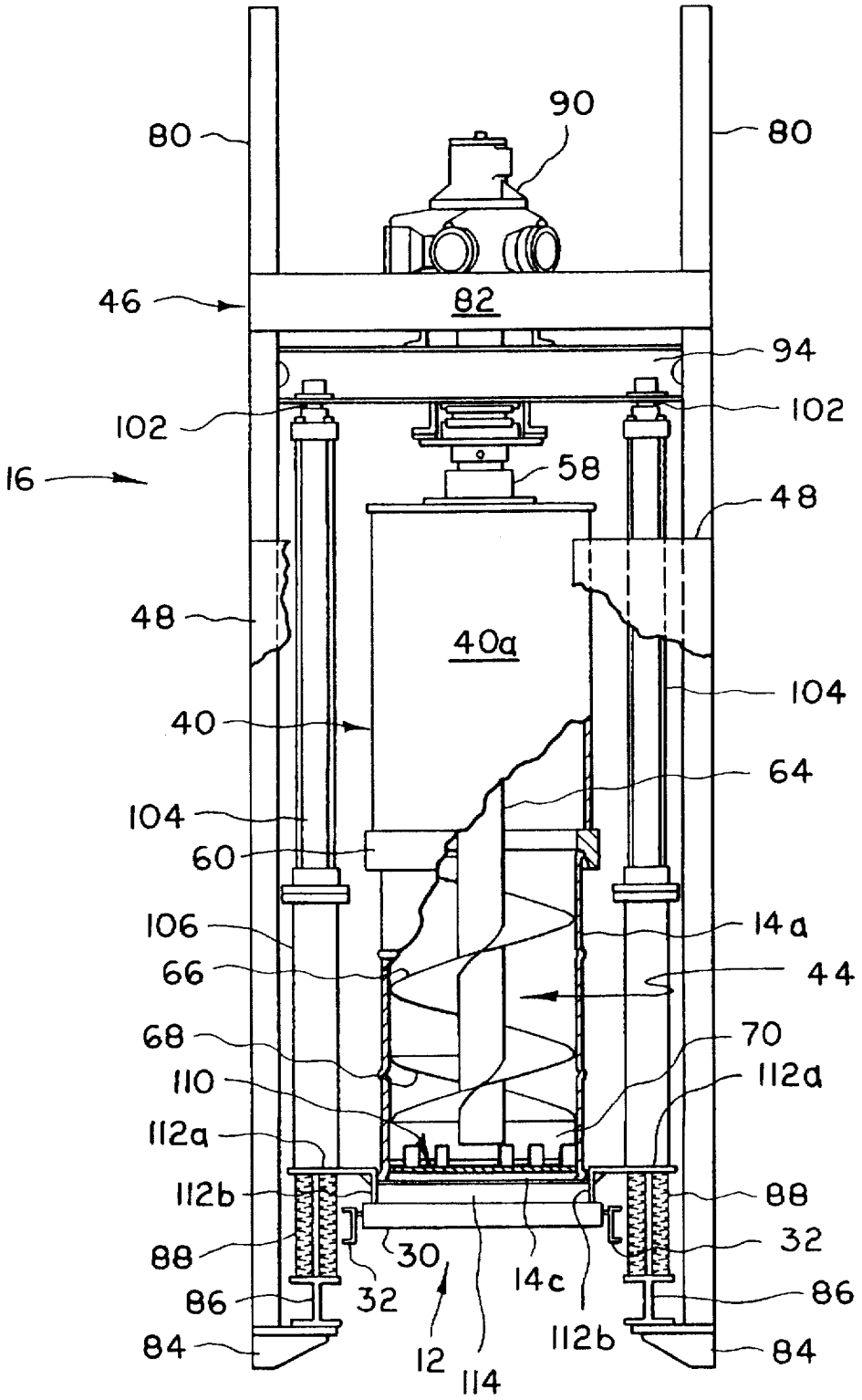
FIG. 6 is a view similar to FIG. 4, but showing a drum emptying auger fully inserted into a drum.

In operation of drum emptying apparatus 10, drums 14 are transported along conveyor 12 for positioning one at a time in vertical alignment with scraper housing 40, as generally indicated in FIG. 4. Once substantial vertical alignment of a drum has been achieved, cylinders 100 and 100 are operated to effect retraction of piston rods 102 and 102 into their fully retracted condition shown in FIG. 6. As retraction of the piston rods is initiated, the initially compressed springs 88 and 88 are freed to undergo expansion with the result that support members 114 are lifted thereby and forced to move vertically relative to rollers 30 until they in succession underengage drum bottom end closure 14c and then lift the drum vertically relative to scraper housing 40 until drum rim **14*b* is brought into clamping engagement with annular clamping surface 60*b*, as shown in FIGS. 5, 6 and 7. The initial compressive loading of springs 88 and 88 and the initial vertical spacing between drum 14 and scraper housing 40 is such that by the time clamping of the drum axially against the scraper housing is effected, support members 114 are lifted above rollers 30 sufficiently to permit subsequent vertical swinging movement of the scraper housing and the engaged drum between their vertically disposed position of FIG. 5 and their vertically tilted position of FIG. 3**.

After clamping of drum 14 axially against scraper housing 40, motor 90 may be operated to effect rotation of scraper head 44, as retraction of piston rods 102 and 102 continues. This serves to effect movement of scraper head 44 outwardly of housing 40 through annular sealing flange 60 and into drum 14, until such time as the scraper head is inserted into the drum sufficiently to place teeth **72*a* and 72*b* of scraper plate 70 closely adjacent or in sliding engagement with the inner surface of drum bottom end closure 14*c*. Rotation and insertion of scraper head 44 serves to scrape material from adjacent inner surface 14*a*' and the inner surface of bottom end closure 14*c* and to convey material from within drum into scraper housing 40 for subsequent discharge therefrom through material discharge opening 40*b***.

Complete insertion of scraper head 44 into an engaged drum 14 is shown in FIG. 6 as occurring before vertical tilting of scraper housing 40 and the engaged drum in order to facilitate comparison of the end positions of the scraper head shown in FIGS. 5 and 6. It will be understood, however, that vertical tilting is preferably effected prior to any substantial extent of insertion of the rotating scraper head into the engaged drum, so that gravity may assist the operation of scraper head in moving material into and through the scraper housing for discharge into material conveyor 20.

After removal of material from drum 14 is completed, operation of drive motor 90 is discontinued and upon completion of transfer of such material to receiver means 18, housing drive mechanism 122 is again operated to return the drum and scraper housing to their initial vertically upright positions and cylinders 100 and 100 are operated to extend piston rods 102 and 102 for purposes of extracting scraper head 44 from within the scraped drum and lowering the bottom end closure **14*c* of such drum into engagement with conveyor rollers 30** to complete a cycle of operation.

As will be apparent, operation of conveyor 12, drive motor 90, hydraulic cylinders 100 and 100, housing drive mechanism 122, and conveyor screw drive motor 134 may be manually controlled for made fully automatic, as desired, with suitable position sensors being provided to determine for example when a filled drum is initially placed in the drum emptying station and a scraped drum is returned to conveyor 12, and the limits of movement of scraper head 44, housing 120 and pistons 102 and 102. Any such controls may be conventional and are thus considered to form no part of the present invention.

While the present commercial form of the invention has been described, it will be understood that changes in construction are anticipated, such as for example, providing lifting means in the form of hydraulic cylinders in substitution for the spring coupling presently arranged between frame 46 and drum support fixture 110, wherein such cylinders are operated to lift the drum support fixture above rollers 30.

What is claimed is:

1. An apparatus for removing material from drums of the type having a generally cylindrical side wall and an end opening bounded by an annular rim comprising:

a housing having a side wall provided with an open end bounded by an annular sealing flange sized to sealingly engage with said annular rim of one of said drums and a discharge opening communicating with said open end;

means for removably placing said annular rim of said drum in sealing engagement with said sealing flange;

scraper means supported for movement from within said housing through said open end and into said end opening for scraping material from within said drum;

a material conveyor supported for rotation about a generally horizontally disposed axis and having axially spaced material inlet and outlet openings, means for transporting material from said inlet opening to said outlet opening, said discharge opening of said housing communicating with said material inlet opening of said conveyor, and said conveyor supporting said housing and said drum sealingly engaged with said sealing flange for vertical tilting movement about said axis to facilitate movement of material scraped from said drum through said housing and into said material conveyor.

2. An apparatus accordingly to claim 1, wherein said sealing flange has a radial inner surface of a diameter corresponding essentially to a cylindrical portion of an inner surface of said side wall of said drum from which material is to be removed, an annular clamping surface for sealing engagement with said annular rim of said drum, and a generally conical guide surface for guiding said annular rim of said drum into engagement with said clamping surface wherein said inner surface of said sealing flange is disposed in essential axial alignment with said cylindrical portion of said inner surface of said side wall of said drum.

3. An apparatus according to claim 2, wherein said scraper means includes a scraper blade having a helical outer edge arranged to slidably engage with said inner surface and said cylindrical portion of said inner surface of said side wall of said drum.

4. An apparatus according to claim 1, wherein said material conveyor includes a generally cylindrical housing defining said material inlet and outlet openings annularly spaced to arrange said inlet and said outlet openings to face vertically in opposite directions, and said means for transporting material is a screw conveyor extending axially within said cylindrical housing.

5. An apparatus according to claim 4, wherein a material receiver is positioned adjacent said apparatus; said discharge opening of said material conveyor is bounded in a direction axially of said cylindrical housing by a pair of parallel, annular and radially outwardly extending flanges and a stationary hood outwardly bounds said cylindrical housing and sealingly engages with said pair of flanges, said stationary hood placing said discharge opening of said material conveyor in flow communication with said material receiver.

6. An apparatus according to claim 1, wherein said means for removably placing said annular rim in sealing engagement with said sealing flange, includes a frame fixed to said housing, a drum support fixture arranged to underengage said drum, lifting means and hydraulic cylinders means for moving said scraper means into and out of said drum, said cylinder means having extended and retracted conditions, and said lifting means being operative to move said drum support fixture and lift said drum to place said annular rim in sealing engagement with said sealing flange incident to movement of said cylinder means from said extended position towards said retracted position.

7. An apparatus according to claim 6, wherein said scraper means is movable through said open end and into said end opening by said cylinder means after movement thereof from said extended condition towards said retracted condition subsequent to movement of said annular rim into sealing engagement with said sealing flange.

8. An apparatus for removing material from drums of the type having a generally cylindrical side wall, an end opening bounded by an annular rim and a bottom end closure comprising:

a receiver means for receiving material removed from said drums;

a scraper housing having a side wall provided with an open end bounded by an annular sealing flange sized to sealingly engage with said annular rim of one of said drums at a time and a discharge opening communicating with said open end;

a material conveyor including a tubular housing supported for oppositely directed rotational movement about a horizontally disposed axis and provided with axially spaced material inlet and discharge openings and a conveyor means within said tubular housing for transferring material between said inlet and discharge openings, said scraper housing being carried by said tubular housing with said discharge opening thereof being disposed in flow communication with said inlet opening of said tubular housing, said discharge opening of said tubular housing being arranged for material flow communication with said receiver means;

means for rotating said tubular housing to tilt said scraper housing between vertically extending and tilted positions;

means for removably positioning said drums one at a time in alignment with said scraper housing while in said vertically extending position with said annular rim thereof disposed in clamping engagement with said sealing flange;

scraper means supported for movement from within said scraper housing through said open end and into a drum engaged with said scraper housing; and means for rotating said scraper means to remove material from said drum.

9. An apparatus for removing material from drums of the type having a generally cylindrical side wall, an end opening bounded by an annular rim and a bottom end closure comprising:

a receiver;

a housing having a side wall provided with an open end bounded by an annular sealing flange sized to sealingly engage with said annular rim of one of said drums and a discharge opening communicating with said open end;

means for removably placing said annular rim of said drum in sealing engagement with said sealing flange;

means supported for movement from within said housing through said open end and into said end opening for removing material from within said drum while said annular rim of said drum is engaged with said sealing flange of said housing;

a material conveyor having a tubular housing supported for rotation about a generally horizontally disposed axis and having axially spaced material inlet and outlet openings, screw means within said tubular conveyor for transporting material from said inlet opening to said outlet opening, said discharge opening of said housing communicating with said material inlet opening of said tubular housing, said outlet opening of said tubular housing being arranged to direct material to said receiver, and said tubular housing supporting said housing and said drum sealingly engaged with said sealing flange for vertical tilting movement about said axis to facilitate movement of material from said drum through said housing and into said material conveyor.

10. An apparatus for removing material from drums of the type having a generally cylindrical side wall and an end opening bounded by an annular rim and a bottom end closure comprising:

a receiver;

a housing having a side wall provided with an open end bounded by an annular sealing flange sized to sealingly engage with said annular rim of one of said drums and a discharge opening communicating with said open end;

a material conveyor having a tubular housing supported for rotation about a generally horizontally disposed axis and having axially spaced material inlet and outlet openings, screw means extending axially within said tubular housing for transporting material from said inlet opening to said outlet opening, said discharge opening of said housing communicating with said material inlet opening of said tubular housing, and said tubular housing supporting said housing for vertical swinging movement about said axis between a vertically extending position and a tilted position, said outlet opening of said tubular housing being arranged to direct material transported by said screw means to said receiver when said housing is in said tilted position;

a conveyor for transporting drums one at a time to position same for vertical alignment with said housing when in said vertically extending position;

means for lifting a drum disposed in vertical alignment with said housing when in said vertically extending position to remove said drum from said conveyor and place said annular rim thereof in sealing engagement with said sealing flange; and scraper means supported for movement from within said housing through said open end and into said drum engaged with said housing for scraping material from adjacent inner surfaces of said side wall and bottom end closure of said drum engaged with said housing.

11. An apparatus for removing material from drums of the type having a generally cylindrical side wall and an end opening bounded by an annular rim and a bottom end closure comprising:

a receiver;

a housing having a side wall provided with an open end bounded by an annular sealing flange sized to sealingly engage with said annular rim of one of said drums and a discharge opening communicating with said open end;

a material conveyor having a tubular housing supported for rotation about a generally horizontally disposed axis and having axially spaced material inlet and outlet openings, screw means extending axially within said tubular housing for transporting material from said inlet opening to said outlet opening, said discharge opening of said housing communicating with said material inlet opening of said tubular housing, and said tubular housing supporting said housing for vertical swinging movement about said axis between a vertically extending position and a tilted position, said outlet opening of said tubular housing being arranged to direct material transported by said screw means to said receiver when said housing is in said tilted position;

a conveyor for transporting drums one at a time to position same for vertical alignment with said housing when in said vertically extending position;

a frame fixed to said housing;

a guide member movably lengthwise of said frame between extended and retracted positions;

a drum support fixture;

compression springs;

piston means having one end coupled to said guide member and an opposite end coupled to said drum support fixture, said piston means having extended and retracted conditions, said piston means when in said extended condition maintaining said guide member in said extended position thereof wherein said frame and said drum support fixture cooperate to compress said springs, said piston means when moved from said extended condition towards said retracted condition thereof allowing said springs to expand, whereby a drum disposed in vertical alignment with said housing is lifted from said conveyor and has said annular rim thereof placed in sealing engagement with said sealing flange; and a scraper head removably received within said housing and mounted for rotation with shaft extending from said housing for connection to a shaft drive motor mounted on said guide member, said scraper head being moved from within said housing and into said drum engaged therewith upon movement of said guide member from said extended position into said retracted position to effect removal of material from within said drum for passage through said housing and said tubular housing for discharge to said receiver.

12. An apparatus according to claim 1, wherein said housing side wall is a cylindrical side wall extending between said open end and said discharge opening.

13. An apparatus for removing material from drums of the type having a generally cylindrical side wall and an end opening bounded by an annular rim comprising:

a housing having a cylindrical side wall provided with an open end bounded by an annular sealing flange sized to sealingly engage with said annular rim of one of said drums and a discharge opening communicating with said open end;

a material conveyor having a conveyor housing supported for rotation about a generally horizontally disposed axis and formed with axially spaced material inlet and outlet openings, and means for transporting material from said inlet opening to said outlet opening, said housing being fixed to said material conveyor for vertical swinging movement between a vertically extending position and a tilted position as said conveyor housing is rotated about said axis, said discharge opening of said housing is disposed in flow communication with said material inlet opening of said conveyor;

a conveyor for transporting drums one at a time past said housing;

means operable when said housing is in said vertically extending position for lifting one of said drums from said conveyor, removably clamping said annular rim of said one of said drums against said sealing flange and retaining said one of said drums supported by said housing during swinging movement of said housing between said vertical extending and tilted positions; and scraper means supported for movement from within said housing through said open end and into said end opening while said sealing flange is engaged with said annular flange for scraping material from within said drum and then transporting said material through said housing to said discharge opening.

14. An apparatus for removing material from drums of the type having a generally cylindrical side wall and an end opening bounded by an annular rim comprising:

a housing having a cylindrical side wall provided with an open end bounded by an annular sealing flange sized to sealingly engage with said annular rim of one of said drums and a discharge opening communicating with said open end;

a material conveyor supported for rotation about a generally horizontally disposed axis and having axially spaced material inlet and outlet openings, means for transporting material from said inlet opening to said outlet opening, said housing being fixed to said conveyor for vertical swinging movement between a vertically extending position and a tilted position as said conveyor is rotated about said axis, said discharge opening of said housing is disposed in flow communication with said material inlet opening of said conveyor;

means for removably clamping said annular rim of one of said drums against said sealing flange when said housing is in said vertically extending position and for retaining said one of said drums supported by said housing during swinging movement of said housing between said vertical extending and tilted positions; and scraper means supported for movement from within said housing through said open end and into said end opening while said sealing flange is engaged with said annular flange for scraping material from within said drum for passage through said housing to said discharge opening.

* * * * *